US005604992A

United States Patent [19]

Robinson

[11] Patent Number: 5,604,992

[45] Date of Patent: Feb. 25, 1997

[54] DUAL ROLL DISPENSER

[76] Inventor: Joe M. Robinson, 1334 Timberlane Rd., Tallahassee, Fla. 32312

[21] Appl. No.: 516,991

[22] Filed: Aug. 18, 1995

Related U.S. Application Data

[63] Continuation-in-part of Ser. No. 373,849, Jan. 18, 1995, Pat. No. 5,442,867.

[51] Int. Cl.[6] ..... F26B 19/00

[52] U.S. Cl. ..... 34/90; 34/215; 34/218; 242/559; 242/560

[58] Field of Search ..... 242/559, 559.3, 242/560, 560.1; 34/90, 202, 427, 210, 215, 218

[56] References Cited

U.S. PATENT DOCUMENTS 4,756,485 7/1988 Bastian et al. ..... 242/560.1
5,146,695 9/1992 Yang ..... 34/202 X
5,163,234 11/1992 Tsukamoto et al. ..... 34/202 X
5,442,867 8/1995 Robinson ..... 34/90

*Primary Examiner*—John M. Sollecito
*Assistant Examiner*—Steve Gravini
*Attorney, Agent, or Firm*—Peter Loffler

[57] ABSTRACT

A dual roll dispenser is disclosed. The device comprises a housing unit having a first paper towel roll and a second paper towel roll mounted therein. Paper automatically dispenses paper from one of the rolls while the second roll remains idle. When a sensor detect that the roll being dispensed is exhausted, the device automatically engages the second paper towel roll and begins dispensing from this second roll. Displays, both local and remote, are activated to communicate a paper absent condition. The device can be used in standalone configuration or in conjunction with an air blower wherein activation of the device activates the air blower for a preset amount of time and thereafter dispenses a single paper towel sheet.

29 Claims, 10 Drawing Sheets

DUAL ROLL DISPENSER

This application is continuation-in-part of patent application Ser. No. 08/373,849 filed Jan. 18, 1995, now U.S. Pat. No. 5,442,867.

BACKGROUND OF THE INVENTION

1. Field of the Invention

The present invention relates to a hand towel dispenser and more specifically to a hand towel dispenser that receives two paper towel rolls such that the device automatically switches from one roll to the other when the first roll is exhausted 2. Background of the Prior Art Dispensers for individual hand towels are well known in the art. Typically, a paper towel roll is mounted within the device and the paper towel sheet is fed into a dispensing mechanism, having either manual or automatic dispension capability, rendering the device operational. Such devices generally provide satisfactory and reliable service.

However, such devices have a major drawback. When the paper towel roll is exhausted, the device is useless until it is refilled. A user attempting to use an empty device will be quite unhappy if that user has to leave the restroom with wet hands. This negative experience will reflect adversely upon the owner of the device.

In order to prevent an out of paper situation, the dispensing device can be monitored frequently, especially when the paper towel roll is nearly exhausted. Such monitoring is an inefficient use of labor, particularly so when the establishment is busy. Even with frequent monitoring, the device can become empty and a client or two may not be able to receive paper and become unhappy before the device is refilled.

What is needed is a device that has the ability to automatically switch to a second roll when the first roll is exhausted. The automatic switching mechanism should be relatively simple and inexpensive to manufacture and the switching process should be not require any effort from the user.

SUMMARY OF THE INVENTION

The dual roll dispenser of the present invention meets the above-stated needs in the art. The present invention holds two paper towel rolls and automatically dispenses paper from one of the rolls. When the first roll is exhausted, the device automatically begins dispensing from the second roll. This gives the operator of the device a relatively large time frame within which to replenish the device without loss of utility.

The device comprises a housing unit having a pair of standard paper towel rolls mounted therein. The first paper towel roll is friction fed by a first set of feed wheels through a first channel and out through an aperture of the device. The second paper towel roll is friction fed by a second set of feed wheels through a second channel and out through the aperture of the device. When one set of the feed wheels is feeding the paper out of the device, the other set of the feed wheels does not dispense.

A paper sensor is located within each channel. When the paper sensor in the active channel senses a paper absent condition, the feed wheels for that channel cease the dispensing function while the other set of feed wheels begin the dispensing function. If both paper sensors detect a paper absent condition, both sets of feed wheels deactivate.

A display means communicates, both locally and remotely, the paper absent condition in one or both of the channels. The display means can also be used to communicate a message of the operator's choice to the user of the device.

The device can be used with an optional air blower. In such a configuration, activation of the device causes the air blower to blow air, heated or unheated, out through the device permitting a user to air dry his or her hands. After an operator selectable preset amount of time, the air blower deactivates and the paper dispenser activates in order to dispense a single sheet of paper. This gives the user a paper towel with which to complete the drying process.

Figure 11:
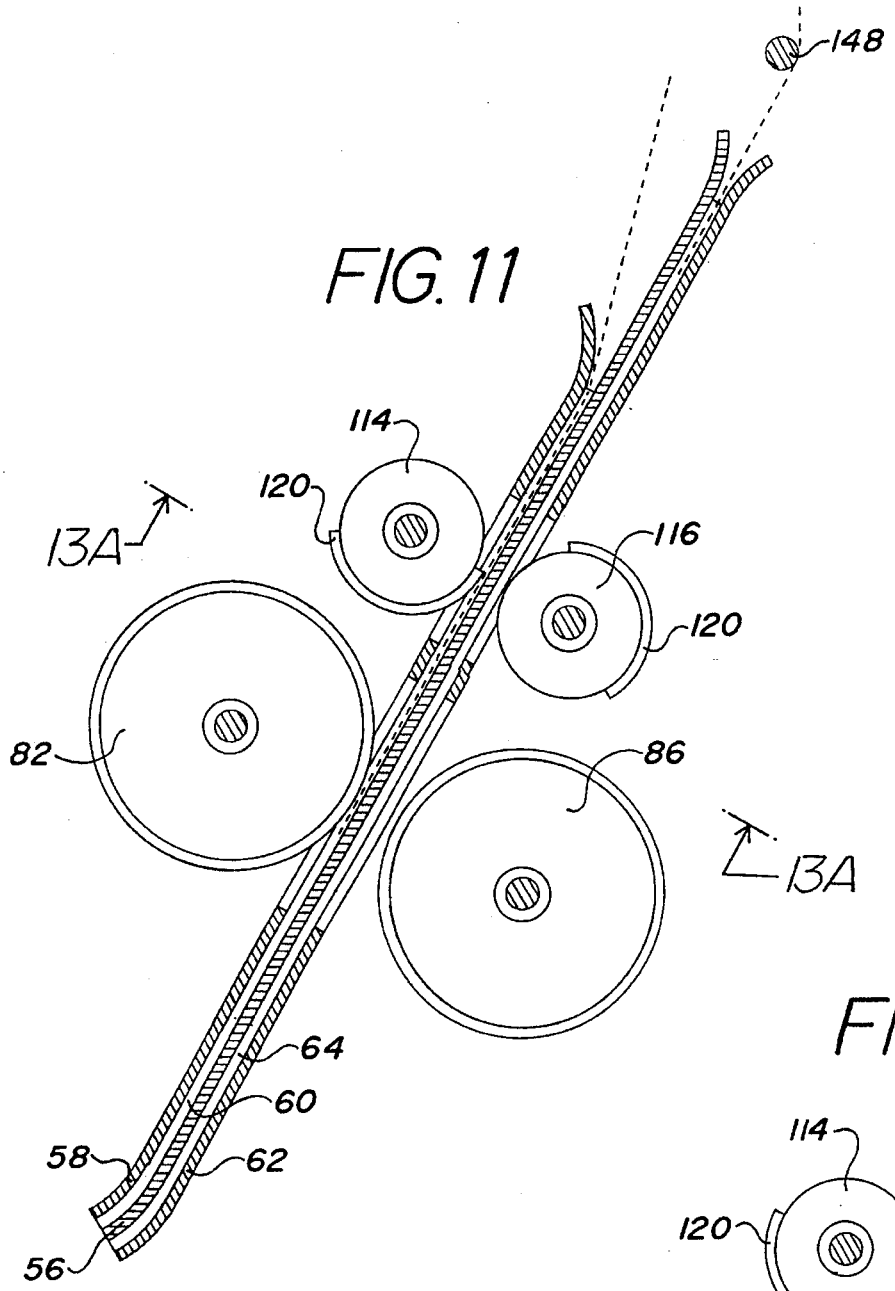
FIG. 11 is a right elevation view of the feed wheel and cam mechanism.

FIGS. **13*a*–16*a* are front cutaway views, taken along line 13A—13A of FIG. 11**, of the cam feed operation during a paper roll changeover cycle.

Figure 1:
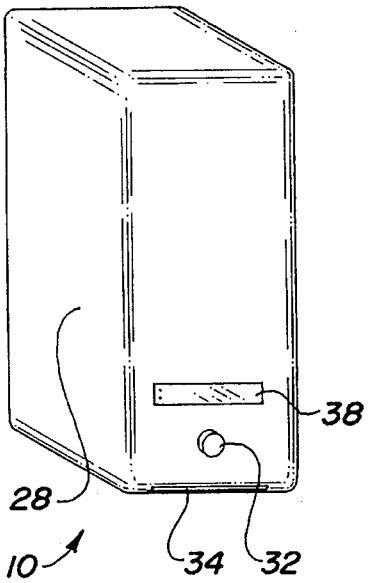
FIG. 1 is a left perspective view of the dual roll dispenser of the present invention.
Figure 2:
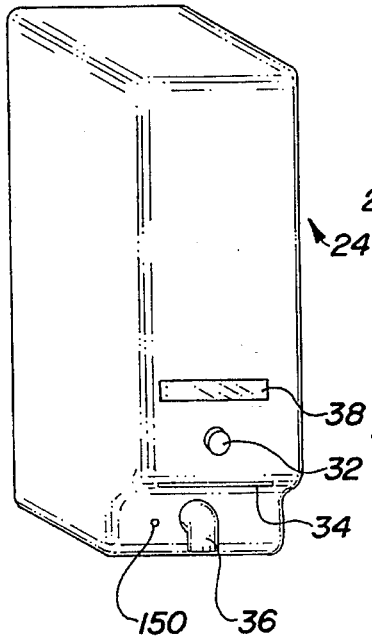
FIG. 2 is a left perspective view of the dual roll dispenser with optional air blower.
Figure 3:
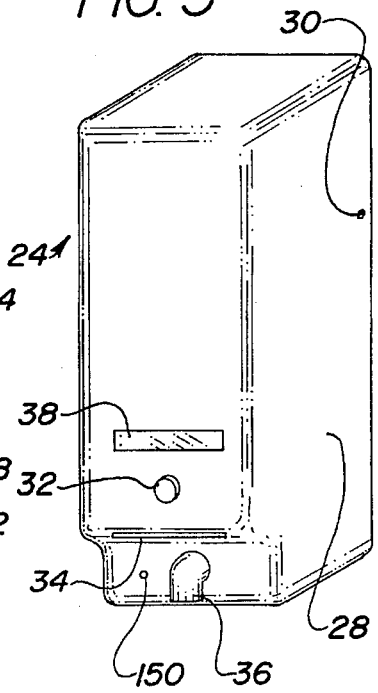
FIG. 3 is a right perspective view of the dual roll dispenser with optional air blower.
Figure 4:
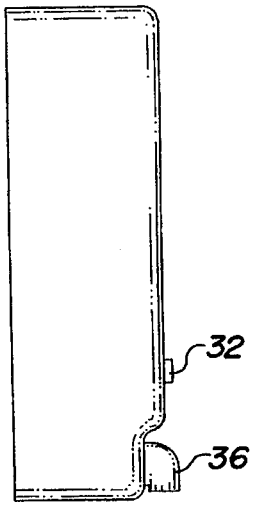
FIG. 4 is a left elevation view of the dual roll dispenser with optional air blower.
Figure 5:
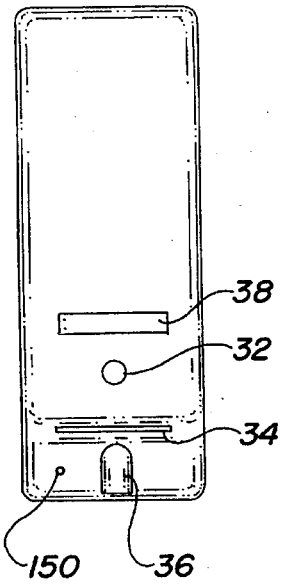
FIG. 5 is a front elevation view of the dual roll dispenser with optional air blower.
Figure 6:
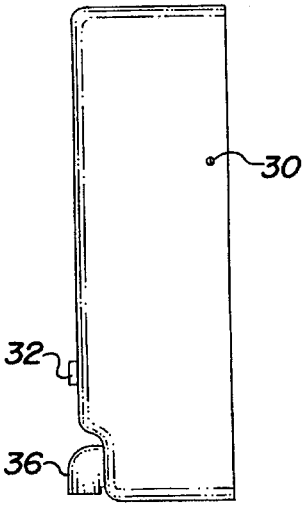
FIG. 6 is a right elevation view of the dual roll dispenser with optional air blower.
Figure 7:
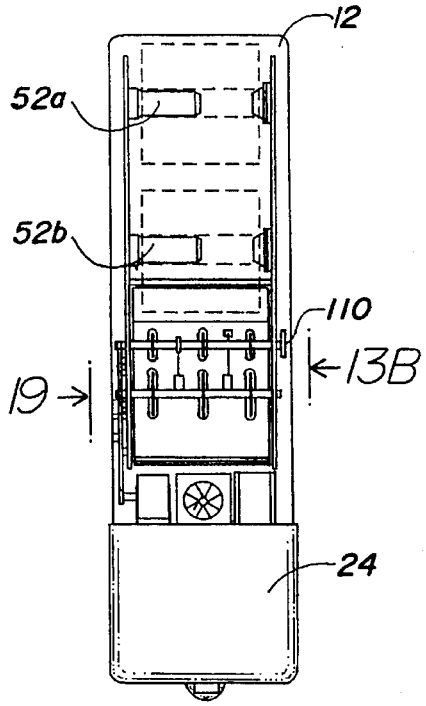
FIG. 7 is a front elevation view of the dual roll dispenser with optional air blower with the housing cover lowered.

FIGS. **13*b*–16*b* are side cutaway views, from point 13B of FIG. 7**, of the cam feed and feed wheel operation during a paper roll changeover cycle.

Figure 17A:
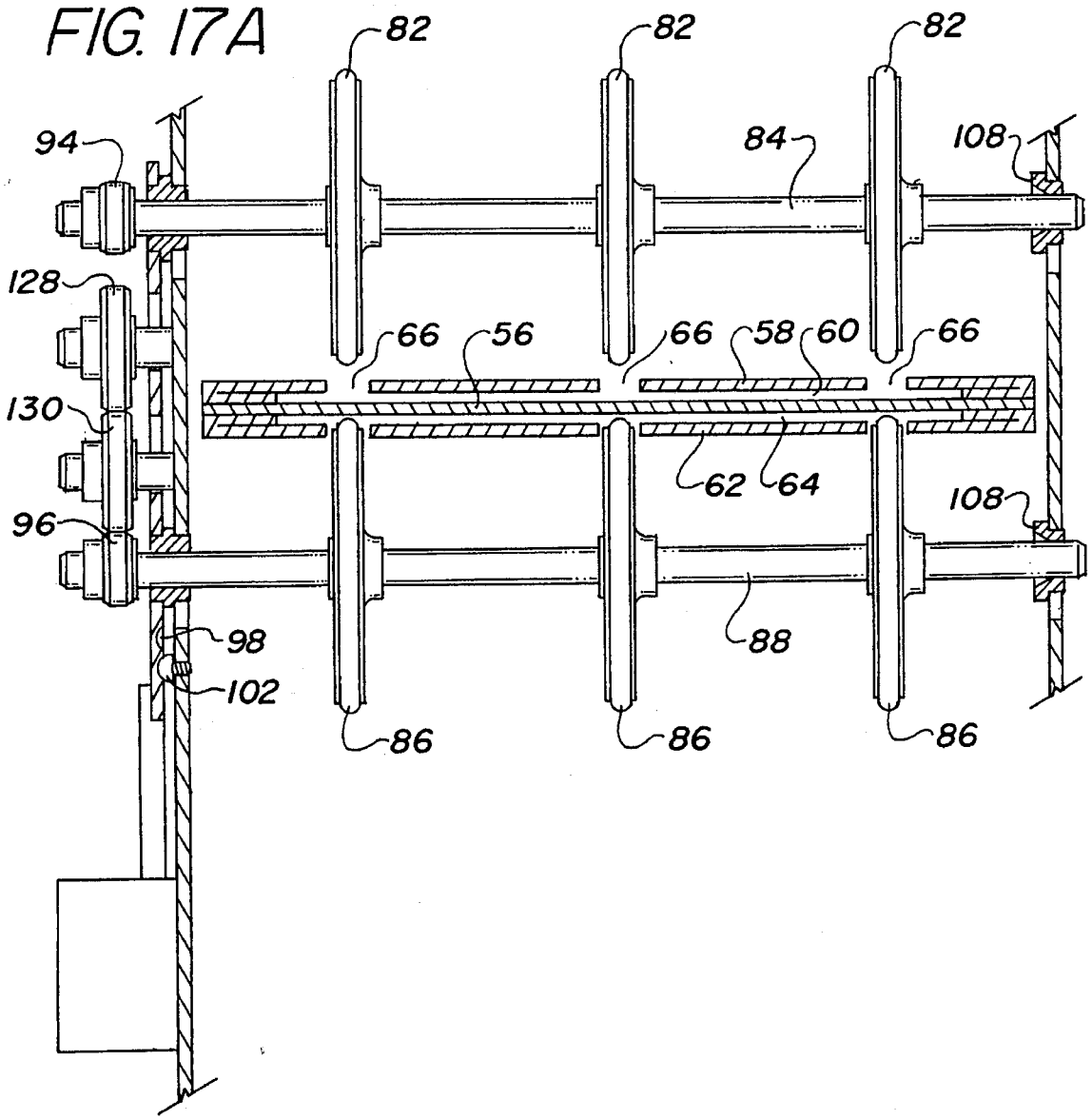

FIG. 17A is a cutaway view of the feed wheels dispensing paper from the second channel.

Figure 17B:
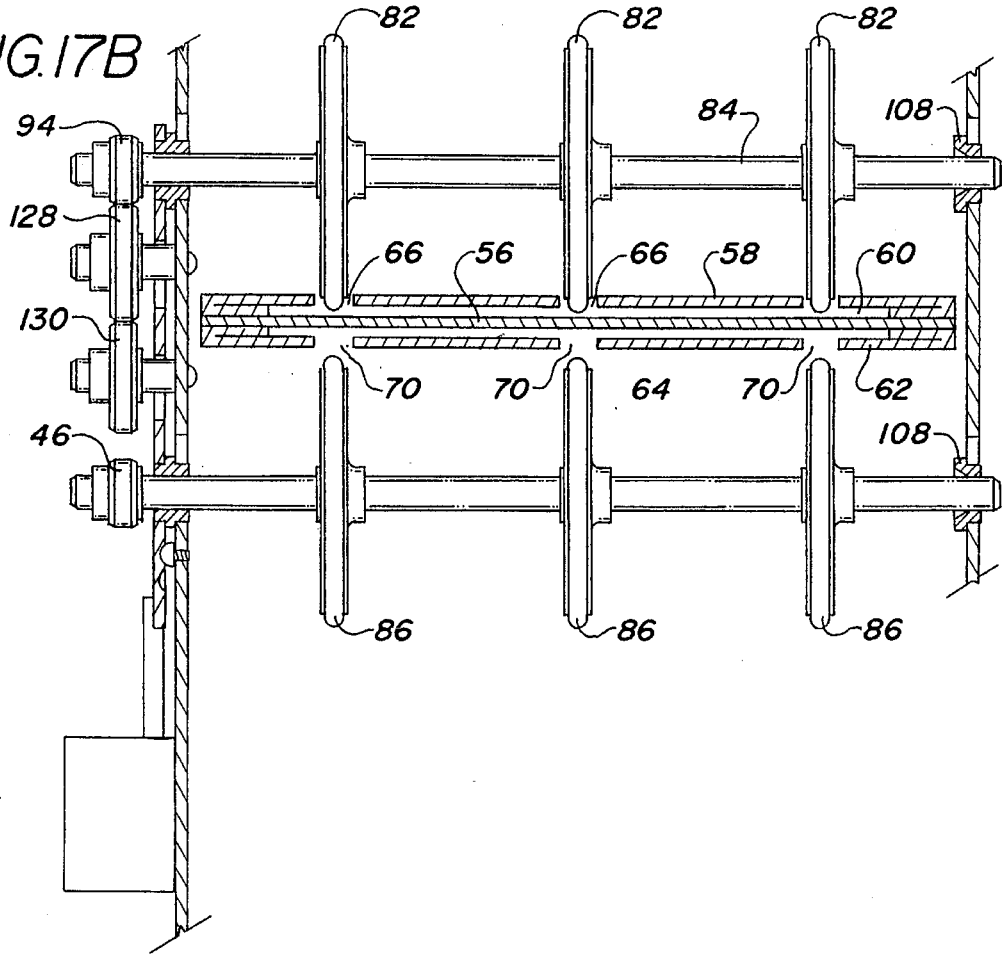

FIG. 17B is a cutaway view of the feed wheels dispensing paper from the first channel.

Figure 18:
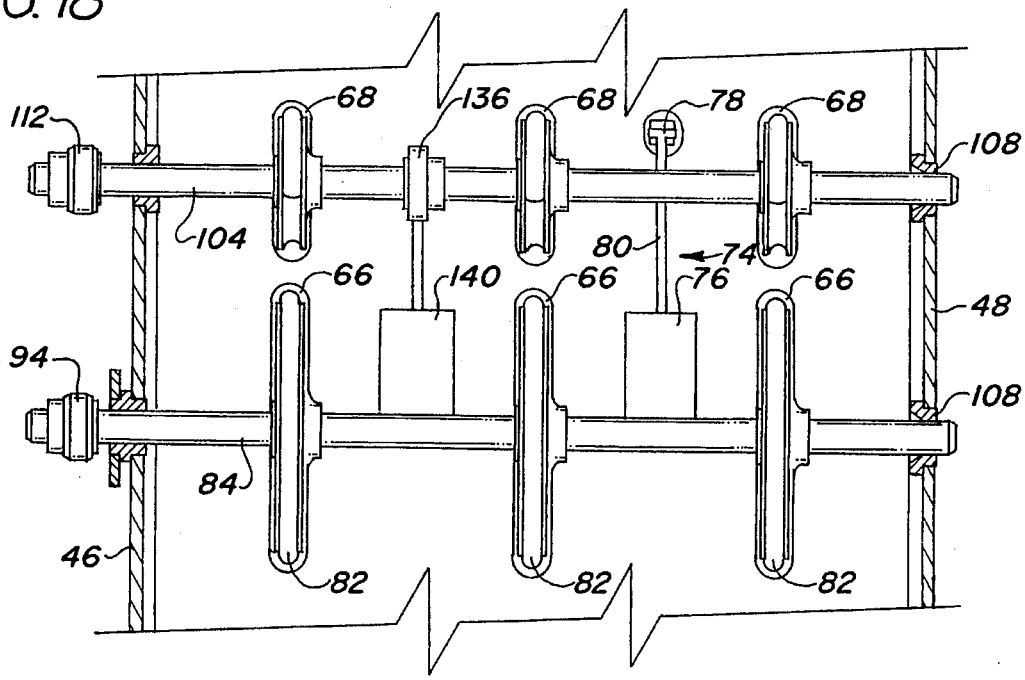

FIG. 18 is a top plan view of the feed wheel and cam feeds for the first channel.

Figure 19:
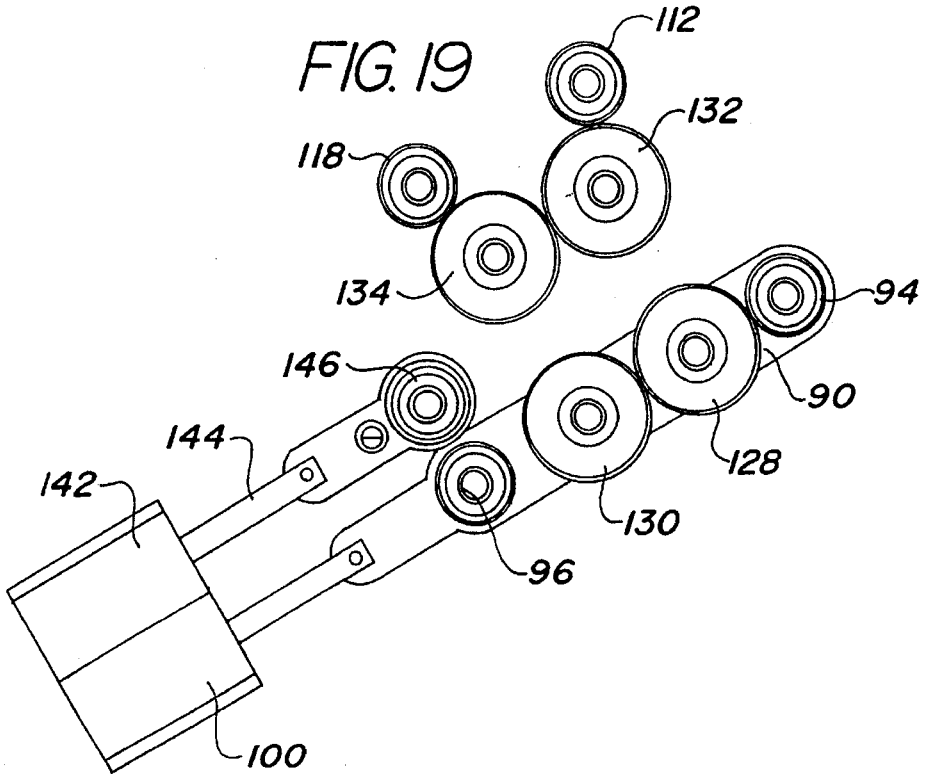

FIG. 19 is a side view, taken at point 19 of FIG. 7, of the first solenoid extended for dispension from the first channel and the second solenoid retracted.

Figure 20:
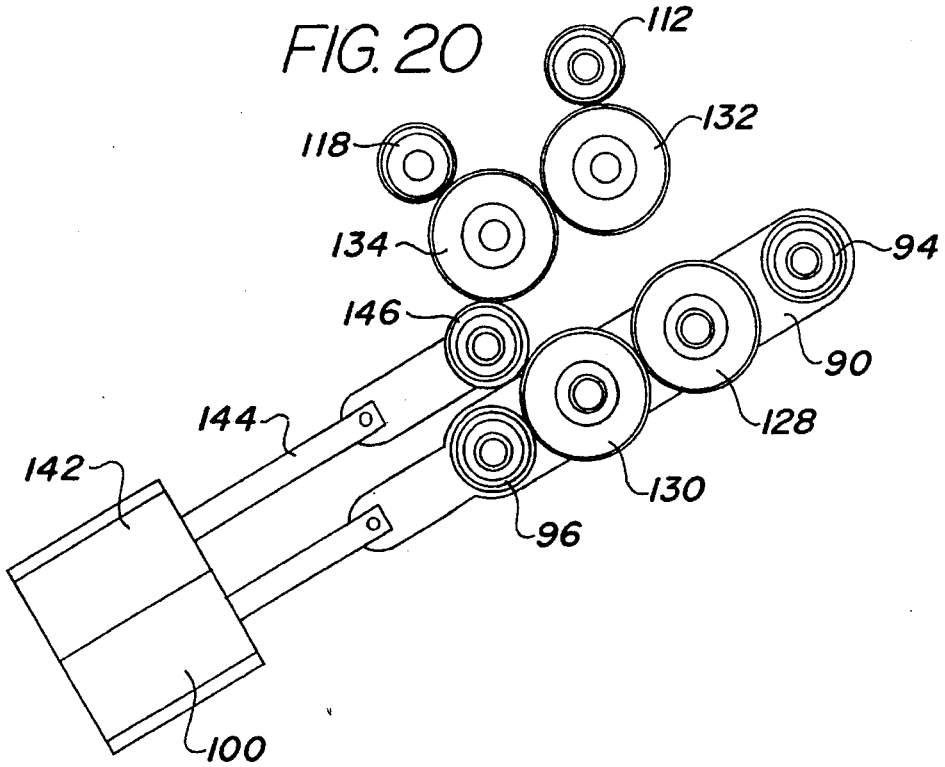

FIG. 20 is a side view, taken at point 19 of FIG. 7, of the first solenoid retracted for dispension from the second channel and the second solenoid extended.

Figure 21:
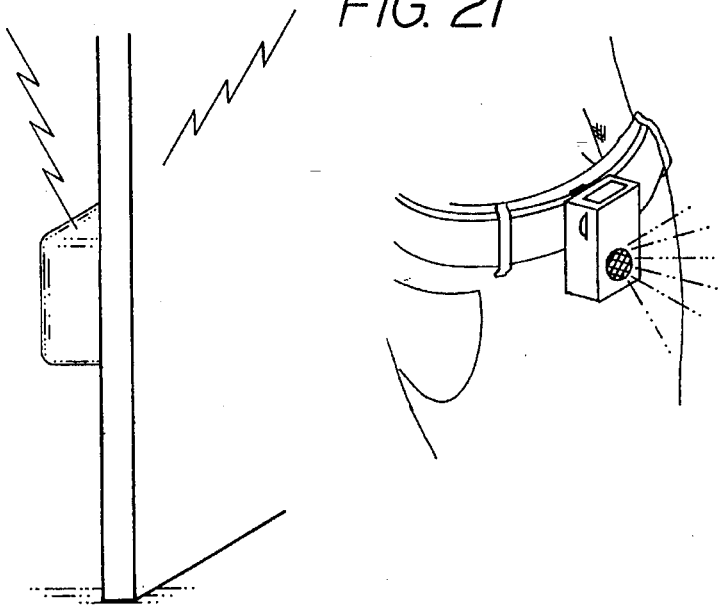

FIG. 21 illustrates the device of the present invention remotely communicating a paper absent condition.

Figure 22:
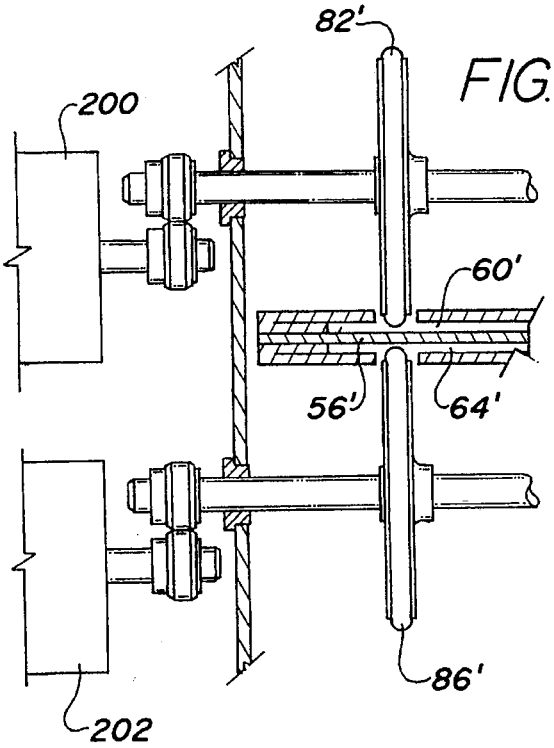

FIG. 22 is an alternate embodiment of the dual roll dispenser of the present invention utilizing dual motors.

Figure 23:
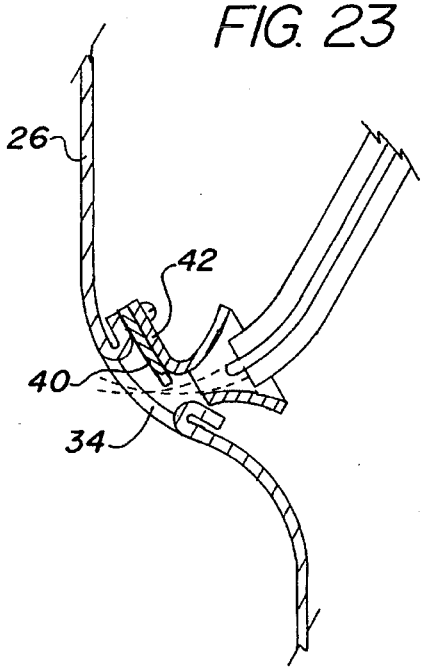

FIG. 23 is a side view of the paper dispensing assembly aligned with the guide at the paper opening.

Figure 24:
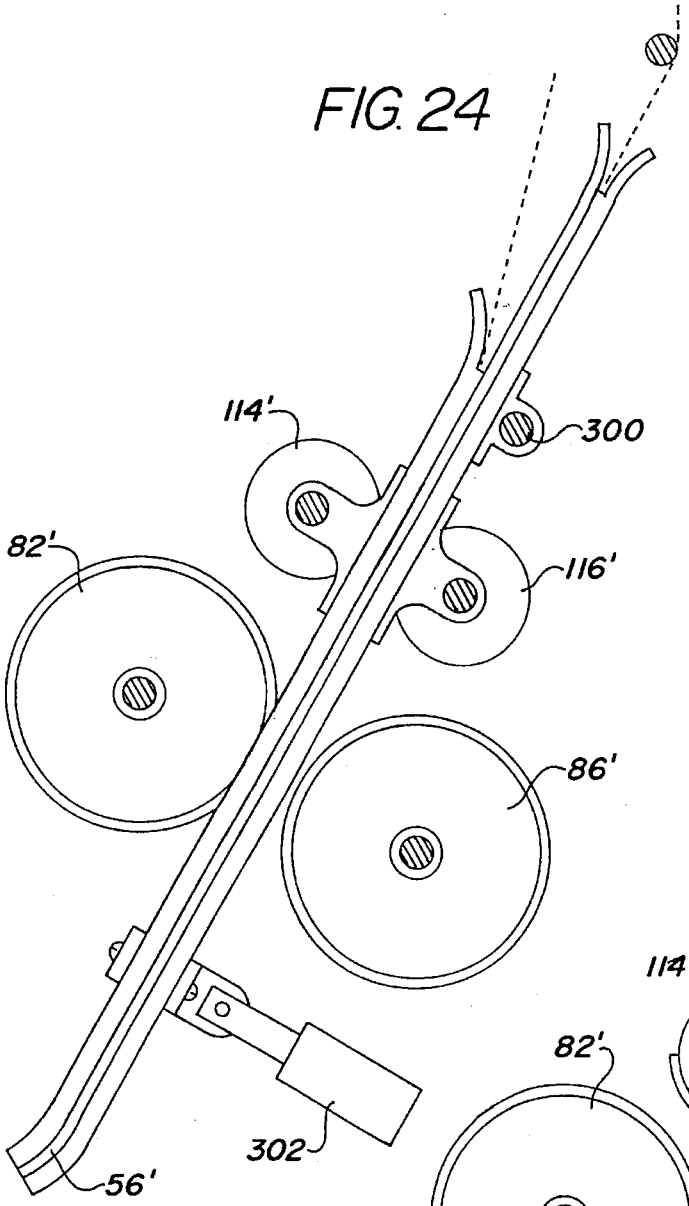

FIG. 24 is a second alternate embodiment of the dual roll dispenser of the present invention utilizing a pivoting paper dispensing assembly dispensing from the second channel.

Figure 25:
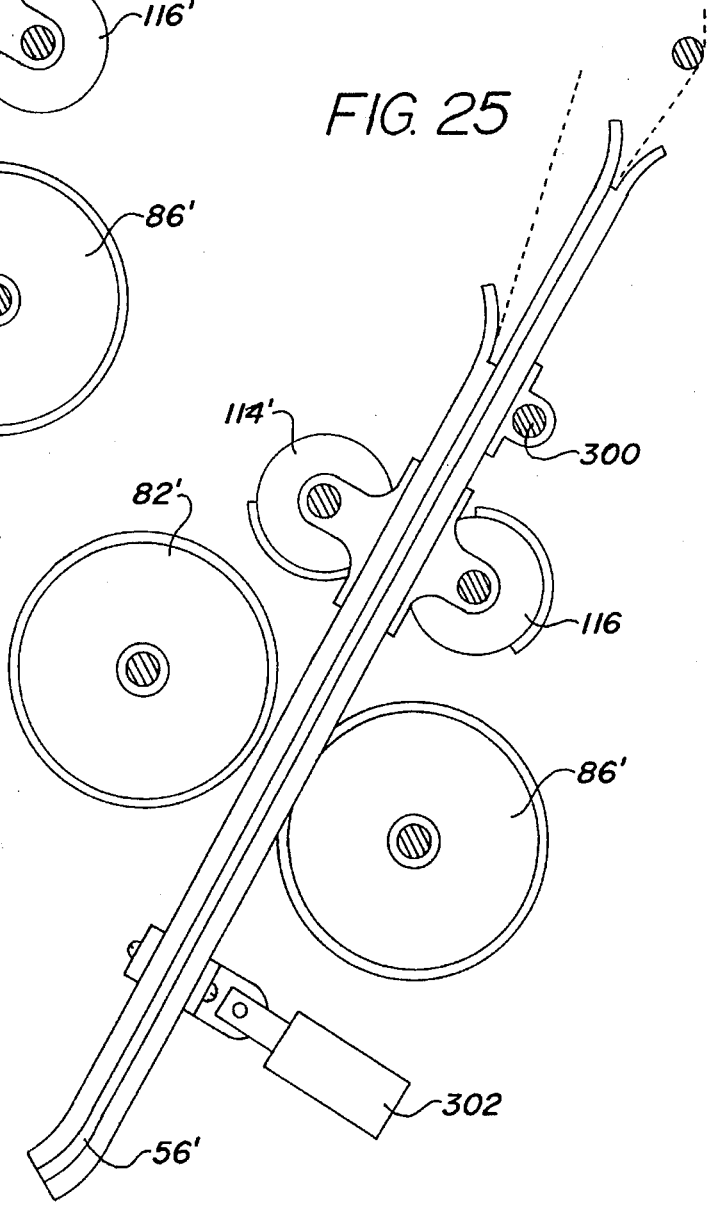

FIG. 25 is a second alternate embodiment of the dual roll dispenser of the present invention utilizing a pivoting paper dispensing assembly dispensing from the first channel.

Similar reference numerals refer to similar parts throughout the several views of the drawings.

DETAILED DESCRIPTION OF THE PREFERRED EMBODIMENT

The dual roll paper towel dispenser of the present invention comprises a housing unit 10 having a back plate 12 and a base portion 14. The base 14 extends outwardly from the bottom of the back plate 12. Located on the base 14 is a motor 16, a control box 18 and an optional air blower 20 for optionally dispensing blown air from the device.

Figure 8:
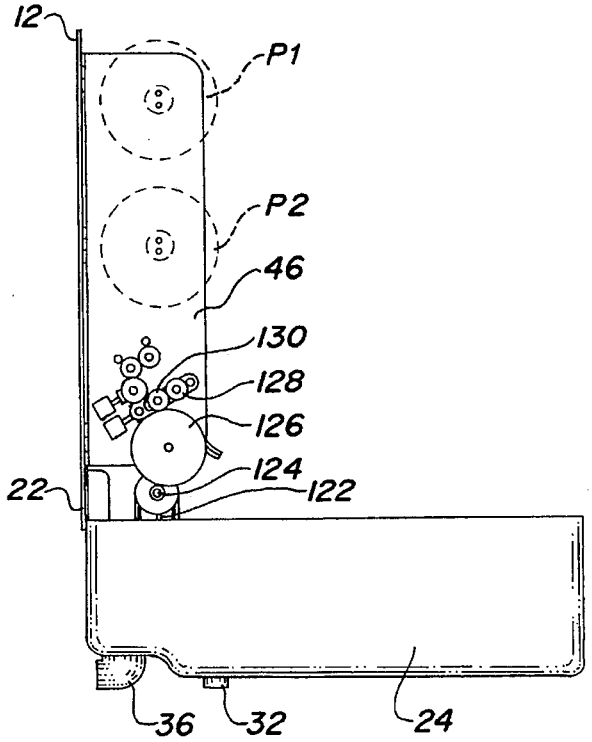
FIG. 8 is a left elevation view of the dual roll dispenser with optional air blower with the housing cover lowered.
Figure 10:
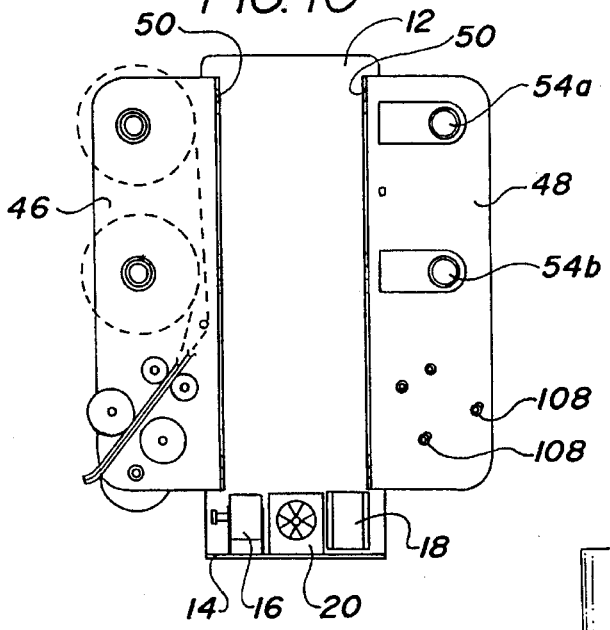
FIG. 10 is a front elevation view of the dual roll dispenser with the side plates swung outwardly.
Figure 9:
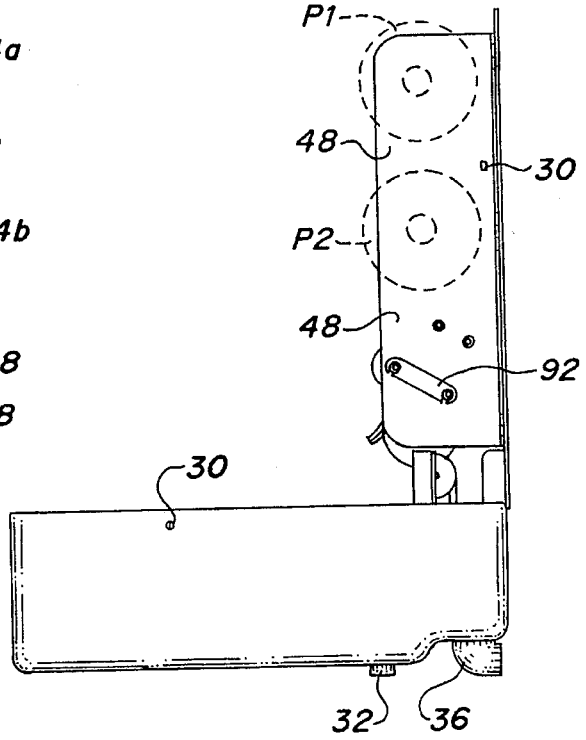
FIG. 9 is a right elevation view of the dual roll dispenser with optional air blower with the housing cover lowered.

Attached to the base 14, by hinge means 22, is a housing cover 24, having a front cover 26 and a pair of side covers 28 integrally attached to either side of the front cover 26. As seen in FIGS. 1–6, in a closed position, the housing cover 24 covers and protects the interior of the housing unit 10. The housing cover 24 attaches to the back plate 12 by a latch means 30. As seen in FIGS. 8 and 9, in an open position, the housing cover 24 articulates into a horizontal position providing service access into the interior of the device. Alternatively, the housing cover 24 can be completely removed. When the housing cover 24 is open, an optional contact switch assembly (not illustrated), locatable at the top of the housing cover 24 and the back plate 12, can be used to disrupt power flow to the motor or motors located within the device for safety reasons.

Located on the housing cover 24, is a switch 32, a paper opening 34 for dispensing paper therefrom, an optional air dispenser 36 and a display device 38. The air dispenser 36 can be a fixed or rotatable nozzle, as shown, or any other air dispenser including a series of louvered air vents. Located on the upper portion of the aperture 34 is a serrated edge 40 for tearing off a dispensed paper towel sheet. A guide 42, having upper and lower flanges 44, helps guide the paper towel sheet from the dispensing mechanism out through the aperture 34. The guide 42 is adjustable.

Attached to the back plate 12 is a left side plate 46 and a right side plate 48. The left side plate 46 and the right side plate 48 are each attached to the back plate 12 by hinge means 50 and each plate can be swung outwardly to permit service access to the mechanisms located therepast. In their closed positions, the two side plates are in parallel relation with one another.

Attached to the left side plate 46 is a pair of core plugs **52*a* and 52*b* disposed in spaced apart fashion. The core plugs 52*a* and 52*b* each receive a standard paper towel roll. As seen, the core plugs 52*a* and 52*b* are of sufficient length so that a paper towel roll can be mounted on the core plug and be maintained thereon without the necessity of supporting the other end of the paper towel roll. A second pair of core plugs 54*a* and 54*b* is located on the right side plate 48. The second pair of core plugs 54*a* and 54*b* is disposed such that when paper towel rolls P1 and P2 are positioned on the first pair of core plugs 52*a* and 52*b* respectively, the second pair of core plugs 54*a* and 54*b*** each receive the opposing end of their respective paper towel roll when the side plates are in a closed position. With the side plates in a closed position, each paper towel roll is free to rotate about its respective core plugs.

Attached to the left side plate 46 is a paper plate 56. A top plate 58 is attached to the top of the paper plate 56 in a generally parallel spaced apart fashion forming a first channel 60, permitting a first paper towel roll stream to pass therethrough. The upper end of the top plate 58 is curved. A bottom plate 62 is attached to the bottom of the paper plate 56 in a generally parallel spaced apart fashion forming a second channel 64, permitting a second paper towel roll stream to pass therethrough. The upper end of the paper plate 56 and the upper end of the bottom plate 62 are each curved.

The top plate 58 has a first set of spaced apart feed wheel apertures 66 and a first set of spaced apart cam apertures 68. The bottom plate 62 has a second set of spaced apart feed wheel apertures 70 and a second set of spaced apart cam apertures 72.

Located within the first channel 60, near its top end before the first set of spaced apart cam apertures 68, is a first paper sensor 74. The first paper sensor 74 detects if paper is present within the first channel 60 at the first paper sensor's location. The first paper sensor 74 can be any appropriate device to detect paper presence. Such devices includes a light beam passing from paper plate 56 to top plate 58. Breaking of the light beam by the paper stream communicates a paper present condition by the paper sensor. An unbroken light beam communicates a paper absent condition. Alternatively, a spring-loaded micro switch 76 having a roller end 78 on the end of its arm 80 can be utilized. The presence of paper raises the arm 80 of the micro switch 76 signaling a paper present condition while the absence of paper lowers the arm signaling a paper absent condition. Two or more paper detection devices, attached in series, can be used to make up the first paper sensor 74 in order to avoid false paper absent conditions caused by slight voids appearing in the paper stream.

A second paper sensor (not illustrated) is located within the second channel 64 in similar position to the first paper sensor 74. The second paper sensor is similar in design and operation and function to the first paper sensor 74.

A first set of spaced apart feed wheels 82 are mounted on a first axle 84 and are positioned over the first set of feed wheel apertures 66, one feed wheel 82 for each aperture 66. A second set of spaced apart feed wheels 86 are mounted on a second axle 88 and are positioned over the second set of feed wheel apertures 70, one feed wheel 86 for each aperture 70. Each feed wheel can be made of resilient material, such as soft plastic or rubber, or can be encompassed by an O-ring or similar device.

One end of the first axle 84 and the second axle 88 are each disposed within a first axle mounting plate 90, located beyond the left side plate 46, while the opposing end of the axles are disposed within a second axle mounting plate 92 located beyond the right side plate 48. Each axle is free to rotate within the two mounting plates. The end of the first axle 84 has a first axle drive wheel 94 attached thereon while the end of the second axle 88 has a second axle drive wheel 96 attached thereon. The side of the first axle mounting plate 90 has a pair of locator notches 98. A first solenoid 100 attaches to the end of the first axle mounting plate 90. The first solenoid 100 moves the first axle mounting plate 90 back and forth. This back and forth movement of the first axle mounting plate 90 causes the two sets of feed wheels to move into and out of their respective feed wheel apertures.

When the first solenoid 100 is in a retracted position, the first set of feed wheels 82 protrude through the first set of feed wheel apertures 66 and make contact with the paper plate 56, while the second set of feed wheels 86 do not completely protrude through the second set of feed wheel apertures 70 and thus do not make contact with the paper plate 56. When the first solenoid 100 is in an extended position, the second set of feed wheels 86 protrude through the second set of feed wheel apertures 70 and make contact with the paper plate 56, while the first set of feed wheels 82 do not completely protrude through the first set of feed wheel apertures 66 and thus do not make contact with the paper plate 56. An alignment screw or stud 102, attached to the left side plate 46, is received within one of the two notched portions 98 of the first axle mounting plate 90 for facilitating proper alignment of the first axle mounting plate 90 and its feed wheel laden axles.

Slotted portions (not illustrated) located on the left side plate 46 and the right side plate 48 permit the back and forth movement of the first axle 84 and the second axle 88.

A third axle 104 and a fourth axle 106 are each rotatably received within the left side plate 46 so that each axle is free to rotate. Each axle is secured to the left side plate 46 so that the axle does not pop out or otherwise separate from the left side plate 46. The opposing end of each axle is received within the right side plate 48 in a tapered bushing 108. This opposing end of each axle is tapered to facilitate receipt within the respective bushing 108 located within the right side plate 48. Attached to the end of the third axle 104 is a hand knob 110 while a third axle drive wheel 112 is mounted on the opposing end. A first set of spaced apart feed cams 114 is mounted on the third axle 104 and positioned over the first set of cam apertures 68, one feed cam 114 for each aperture 68. Each feed cam 114 protrudes through its respective aperture 68. A second set of spaced apart feed cams 116 is mounted on the fourth axle 106 and positioned over the second set of cam apertures 72, one feed cam 116 for each aperture 72. Each feed cam 116 protrudes through its respective aperture 72. A fourth axle drive wheel 118 is located on the end of the fourth axle 106.

Figure 12:
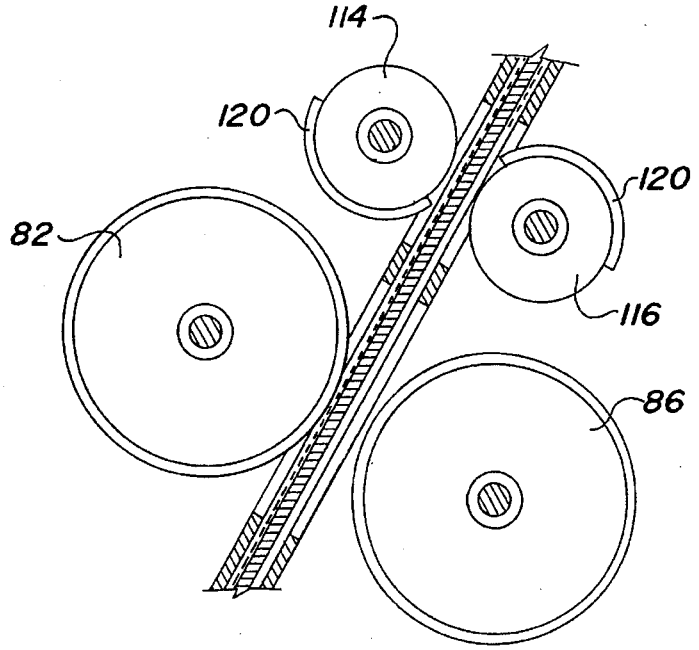
FIG. 12 is a right elevation view of the cam mechanism receiving a paper stream in the first channel.
Figure 13A:
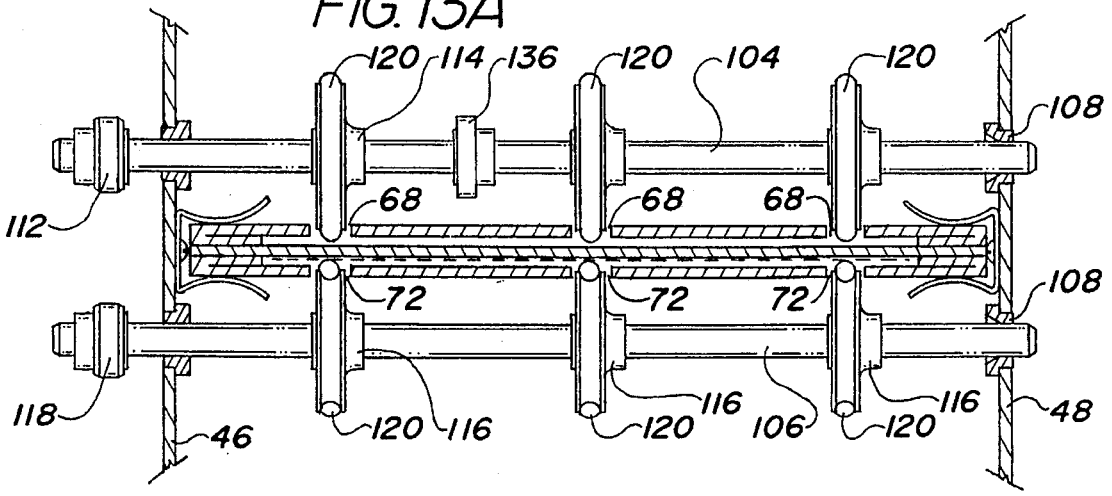

As seen in FIGS. 11 and 12, each feed cam 114 and 116 has a raised portion 120 that extends over slightly less than half of the feed cam's circumference. The raised portions 120 of the first Set of feed cams 114, which raised portions 120 are all aligned with one another, are out of phase with the raised portion 120 of second set of feed cams 116, which are also all aligned with one another. This will assure that while the raised portions 120 of one set of feed cams is in contact with the paper plate 56, the raised portions 120 of the other set of feed cams is not in contact with the paper plate 56.

A motor 16 is located within the base 14. The motor 16 has a shaft 122 extending outwardly. Attached to the end of the shaft 122 is a motor drive wheel 124. Activation of the motor 16 causes rotation of the motor drive wheel 124. The motor drive wheel 124 contacts a transmission wheel 126 such that rotation of the motor drive wheel 124 causes rotation of the transmission wheel 126. In turn, the transmission wheel 126 contacts a first idler wheel 128, which in turn contacts a second idler wheel 130. Rotation of the transmission wheel 126 causes rotation of the first idler wheel 128, which causes rotation of the second idler wheel 130 in opposite direction. The first idler wheel 128 and the second idler wheel 130 are axlely mounted on the left side plate 46.

As seen in FIGS. 19 and 20, a first cam drive wheel 132 contacts the end of the third axle drive wheel 112 such that rotation of the first cam drive wheel 132 causes rotation of the third axle drive wheel 112 and thus the third axle 104. The first cam drive wheel 132 also contacts a second cam drive wheel 134 such that rotation of the first cam drive wheel 132 causes rotation of the second cam drive wheel 134. The second cam drive wheel 134 contacts the fourth axle drive wheel 118 such that rotation of the second cam drive wheel 134 causes rotation of the fourth axle drive wheel 118 and thus the fourth axle 106. The first cam drive wheel 132 and the second cam drive wheel 134 are axlely mounted on the left side plate 46. A sensor cam 136, located on the third axle 104, has a pair of lobes 138 in 180 degree spaced apart relation. A micro switch 140 is positioned such that rotation of the third axle 104 will cause the lobes 138 to make contact with the micro switch 140 each time one of the lobes 138 passes the micro switch 140.

A second solenoid 142 is attached to the left side plate 46. Axlely attached to the end of the second solenoid's rod 144 is a cam transmission wheel 146. When the second solenoid 142 is in its extended position, the cam transmission wheel 146 contacts the second idler wheel 130 such that rotation of the second idler wheel 130 causes rotation of the cam transmission wheel 146. The cam transmission wheel 146 also contacts the second cam drive wheel 134 such that rotation of the cam transmission wheel 146 causes rotation of the second cam drive wheel 134.

In order to utilize the device of the present invention, the second axle mounting plate 92 is removed from the ends of its axles and the right side plate 46 is swung outwardly in order to permit access to the internal core plugs. A first paper towel roll P1 is mounted on the upper core plug **52*a*. The paper end of the first paper towel roll is fed into the first channel 60 until the paper contacts the first set of feed wheels 82. Rotation of the hand knob 110 can be utilized in order to facilitate proper feeding of the paper to the feed wheels 82. The curving of the paper plate 56 and top plate 58 facilitate the feeding of the paper into the first channel 60. If necessary a roller 148 can extend from the left side plate 46** for proper routing of the paper.

A second paper towel roll P2 is mounted on the lower core plug **52*b*. The end of the second paper towel roll is fed into the second channel 64. The curving of the bottom plate 62 facilitates the feeding of the paper into the second channel 64. The hand knob 110 is rotated until the raised portions 120 of the second set of cam drive wheels 116 clamp the paper fed onto the paper plate 56. In such a position, the raised portions 120 of the first set of feed cams 114 do not contact the paper plate 56. Thereafter, the right side plate 46 is swung closed and the second axle mounting plate 92** is replaced.

In this position, the device is in an initial state. The first solenoid 100 and the second solenoid 142 are each in their retracted position and each of the paper sensors are in a paper present state. With the first solenoid 100 in a retracted position, the first axle mounting plate 90 is also in a retracted position. This causes the first set of feed wheels 82 to make contact with the paper plate 56 while the second set of feed wheels 86 do not contact the paper plate 56. As such, the first axle drive wheel 94 contacts the first idler wheel 128 while the second axle drive wheel 96 does not contact the second idler wheel 130.

With the second solenoid 142 in a retracted position, the cam transmission wheel 146 contacts neither the second idler wheel 130 nor the second cam drive wheel 134. A user activates the device by depressing the switch 32 causing the motor 16 to activate. This causes rotation of the motor drive wheel 124, thereby rotating the transmission wheel 126, thereby rotating the first and second idler drive wheels, thereby rotating the first axle drive wheel 94 currently in contact with the first idler drive wheel 128, thereby rotating the first set of feed wheels 82. As the first set of feed wheels 82 contact the paper plate 56, the paper located within the first channel 60 is friction fed through the channel 60 and out through the paper opening 34.

After a predetermined amount of time, the motor 100 is deactivated thereby ceasing paper dispension. The user detaches the dispensed paper by tearing it along the serrated edge 40. A timer locatable within the control box 18, controls starting and stopping of the motor 100. This timer is owner adjustable so that longer or shorter motor activation times can be selected resulting in longer or shorter lengths of paper being dispensed.

Device operation will proceed in this manner as long as the presence of paper is detected within the first channel 60 by the first paper sensor 74. Once the first paper sensor 74 detects a paper absent condition, the first solenoid 100 is toggled and thus extended. This causes the first axle mounting plate 90 to extend resulting in the first set of feed wheels 82 to loose contact with the paper plate 56 and the second set of feed wheels to gain contact with the paper plate 56. This also causes the first idler drive wheel 128 to loose contact with the first axle drive wheel 94 and the second idler drive wheel 130 to gain contact with the second axle drive wheel 96. At the same time, the second solenoid 142 is activated causing the cam transmission wheel 146 to come into contact with both the second idler wheel 130 and the second cam drive wheel 134. The rotating transmission wheel 126 rotates the second idler drive wheel 130, which in turn rotates the extended cam transmission wheel 146, which in turn rotates the second cam drive wheel 134, which in turn rotates the first cam drive wheel 132. The rotating first cam drive wheel 132 rotates the third axle drive wheel 112 while the rotating second cam drive wheel 134 rotates the fourth axle drive wheel 118. The rotating third axle drive wheel 112 rotates the first set of feed cams 114 while the rotating fourth axle drive wheel 118 rotates the second set of feed cams 116. The second set of feed cams 116 friction feed the paper clamped underneath toward the second set of feed wheels 86. Once one of the lobes 138 located on sensor cam 136 contacts the micro switch 140, the second solenoid 142 is deactivated causing it to retract thereby disengaging the cam transmission wheel 146 from the second idler drive wheel 130 and the second cam drive wheel 134, thereby causing rotation of the two sets of cam drive wheels to cease. The lobe 138 contacting the micro switch 140 coincides with the paper being fed far enough by the second set of feed cams 116 so that the second set of feed wheels 86 will engage the paper so fed, and thus the second set of feed wheels 86 can begin the normal dispension cycle from the second paper towel roll P2. The raised portion 120 on the second set of feed cams 116 assures that the paper is fed only a sufficient distance until the second set of feed wheels 86 can engage the paper.

The above paper roll change cycle can occur immediately after the first paper sensor 74 detects a paper absent condition or it can occur when the next user depresses the switch 32 to begin a paper dispensing cycle. If the second paper sensor already detects a paper absent condition when the first paper sensor 74 detects a paper absent condition, then the paper roll change cycle does not occur and the device simply ceases to operate until one of the paper sensors detects a paper present condition. The display device 38 can communicate the paper absent condition to users.

When the first paper sensor 74 detects a paper absent condition, a light or similar signal is displayed on the display device 38 in order to let the operator know that the device requires paper replenishment. Optionally, the paper absent condition can also be communicated, along with a time stamp, to a remote location such as a manager's office, a portable beeper device or the front desk. This communication can occur through wire or wireless means.

In addition, the display device 38 can display operator programmed messages, either fixing or streaming, for advertisement or similar purposes.

Figure 13B:
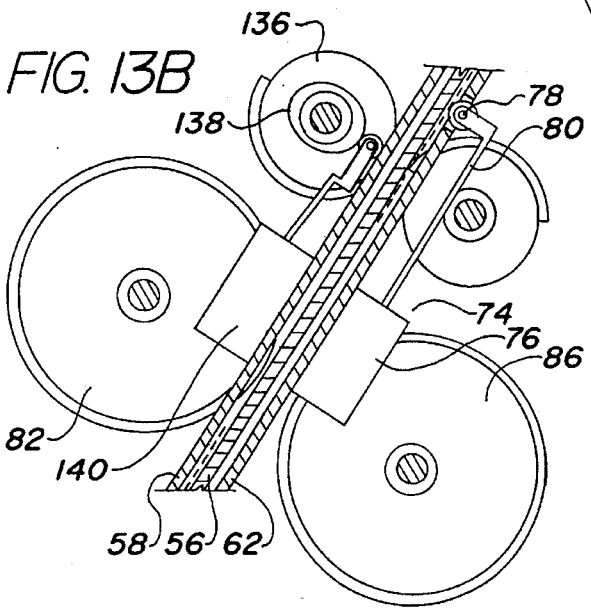
Figure 16B:
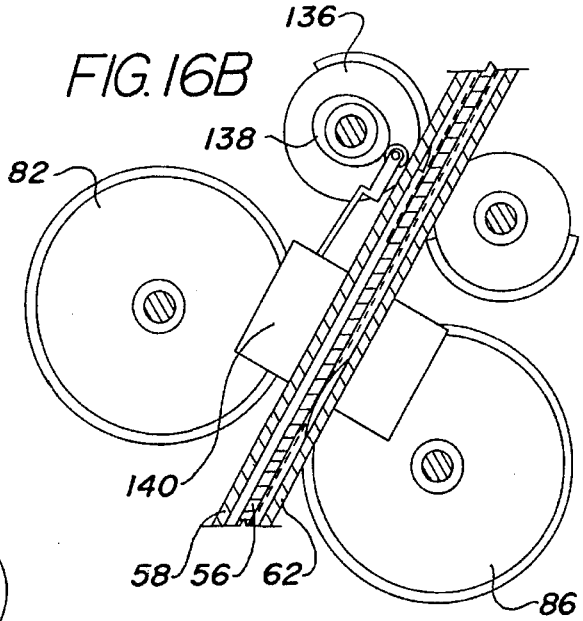

While the device is dispensing paper towels from the second paper towel roll P2, the operator can replace the absent first paper towel roll. Once the new first paper towel roll is mounted on the core plugs 52*a*, the end of the roll is fed into the first channel 60. The hand knob 110 is rotated until the first set of cam drive wheels 132 engage the fed in paper and thereby clamp it to the paper plate 56 (FIGS. 13B and 13B). At this point, the first paper sensor 74 will detect a paper present condition and the paper absent signal for the first channel on the display device 38 is deactivated. However, the device continues to dispense paper from the second paper towel roll P2 until the second paper sensor detects a paper absent condition in the second channel 64.

Figure 14A:
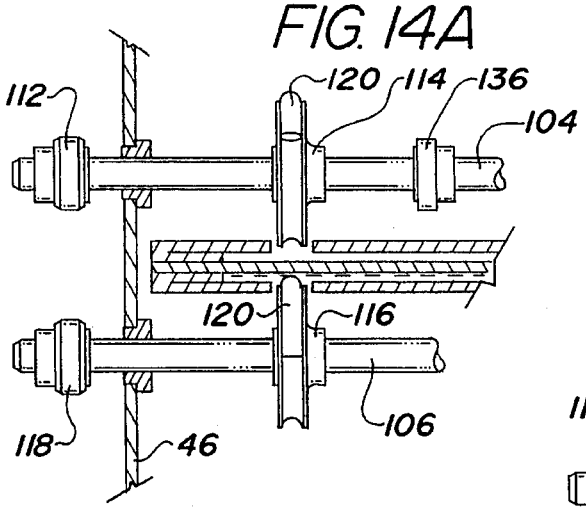
Figure 16A:
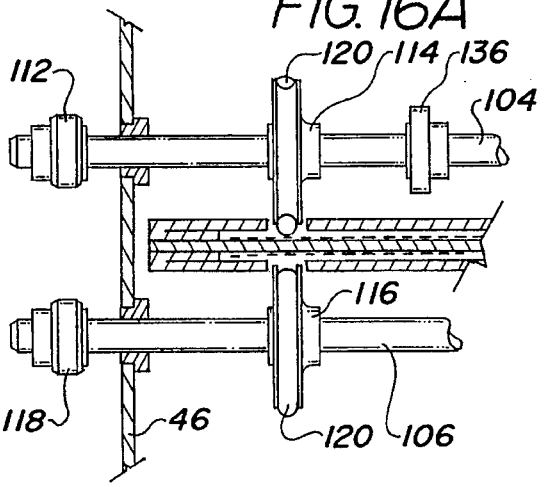
Figure 15A:
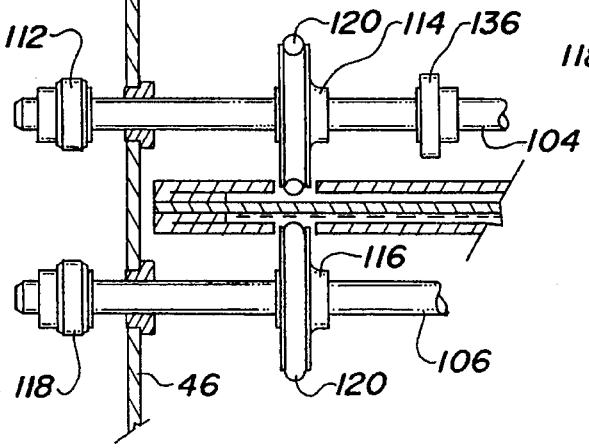
Figure 15B:
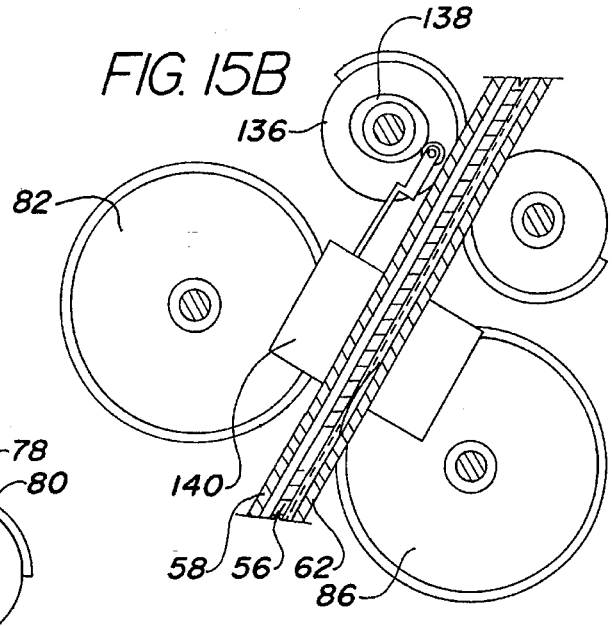
Figure 14B:
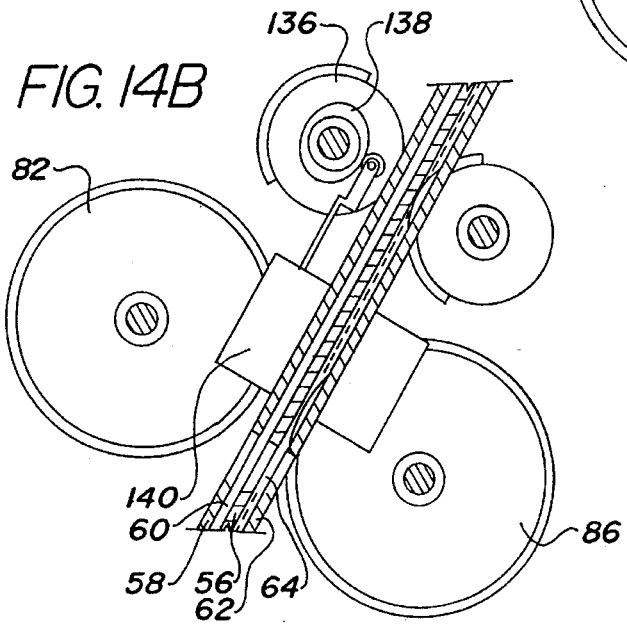

Once this occurs, the first solenoid 100 is toggled causing the device to switch back to dispension from the first paper towel roll P1. The second solenoid 142 is activated in order to complete a paper feed cycle. Both sets of cam wheels rotate causing the paper stream in the first channel 60 to be fed to the first set of feed wheels 82 (FIGS. 14A and 14B). Once this occurs, one of the lobes 138 contacts the micro switch 140, deactivating the second solenoid 142 (FIGS. 15A and 15B). The first set of feed wheels 82 engage the paper stream and the device is ready for paper dispension from the first paper towel roll P1. As seen in FIGS. 15A and 15B, when the second set of feed cams 116 ceases to rotate, the raised portions 120 of the first set of cam feed wheels 114 do not contact the paper plate 56, and the end of the raised portions 120 of the second set of feed cams 116 are in position to accept a new paper towel stream and clamp it in place onto the paper plate 56. As usual, if the first paper sensor 74 detects a paper absent condition, the device does not cycle but merely remains idle until at least one of the paper sensors detects a paper present condition in its respective channel. The display device 38 activates to communicate the paper absent condition in the second channel 64. The same signal can be shared by both paper sensors or preferably, the paper sensor for each channel will activate its own unique signal when it detects a paper absent condition. The paper absent condition can again be automatically transmitted to a remote location.

As seen in FIG. 22, an alternate means is disclosed for changing from one paper towel roll to the other. In this embodiment the first set of feed wheels 82' is rotatable by a first motor 200 while the second set of feed wheels 86' is rotatable by a second motor 202. In this embodiment, the first motor 200 is initially active, dispensing paper from the first paper towel roll P1, while the second motor 202 is inactive. When the first paper sensor detects a paper absent in the first channel 60', the first motor 200 is deactivated and the second motor 202 is activated and dispensing begins from the second paper towel roll P2. When the second paper sensor detects a paper absent condition in the second channel 64', the second motor 202 is deactivated and the first motor 200 is activated. If both paper sensor detect a paper absent condition, both motors are simply idled. All paper absent conditions are communicated, locally and remotely, as usual.

In this embodiment, the cam feed wheels are not necessary. When paper is initially fed into one of the channels, a hand knob (not illustrated) located on the end of the feed wheel laden axle for that channel is rotated in order to clamp the paper stream in place by the feed wheels for that channel onto the paper plate 56'. Alternately, a switch means (not illustrated) can be depressed in order to momentarily activate the motor for that channel. This will cause the feed wheels, associated with that motor, to automatically clamp the paper. As such, the functioning of the contact switch assembly (if used) would be overridden to permit this operation.

As seen in FIG. 24, a second alternate means is disclosed in order to change dispension from one paper towel roll to the other. In this alternate means, the paper plate 56' and its accompanying first and second channels are pivotally mounted by pivot means 300 within the device while the first set of feed wheels 82' and the second set of feed wheels 86' remain stationary. A solenoid 302 causes up and down pivoting of the paper plate assembly. When the paper plate assembly is in an upper position, the second set of feed wheels 86' contact the paper plate 56' and paper is dispensed from the second paper towel roll P2. When the paper plate assembly is in a lower position, the first set of feed 82' wheels contact the paper plate 56' and paper is dispensed from the first paper towel roll P1.

In this embodiment, the first set of feed cams 114' and the second set of feed cams 116' ride with the pivoting paper plate assembly. Therefore, the both sets of feed cams are axlely mounted directly on the paper plate assembly. Paper loading and the paper roll changeover cycle occur in similar fashion to the original embodiment.

The dual roll dispenser of the present invention can be used in a stand alone configuration or with an optional air blower 20. In such an alternate embodiment, a timer would be located within the control box 18. The timer, in electrical communication with the switch 32, is designed so that when the switch 32 is activated, the air blower 20 is turned on for a preset amount of time. The air blower 20, which can have an optional heater element for blowing heated air, blows air out through the air dispenser 36. After expiration of the preset amount of time, the timer would deactivate the air blower 20 and would activate the paper dispensing mechanism for a preset amount of time for dispension of a sheet of paper in the usual way. After expiration of this second preset amount of time, the timer deactivates the paper dispensing mechanism. The function of the switch 32 is disabled during the operation cycle of the device. As such, activation of the switch 32 will have no effect on the length of either the air blower or motor cycle. The length of the air blower cycle and the length of the paper dispensing cycle can be changed as required. If the first paper sensor and the second paper sensor each detect a paper absent condition, the timer can automatically lengthen the length of the air blower cycle as the user will not receive a paper towel roll and will need an extended air blower cycle.

An infrared or other similar "electric eye" 150 can be mounted in proximity to the air dispenser 36 for automatic activation of the device when the presence of a user is detected.

While the invention has been particularly shown and described with reference to embodiments thereof, it will be recognized by those skilled in the art that various changes in form and detail may be made without departing from the spirit and scope of the invention.

I claim:

1. A dual roll dispenser comprising:

a housing unit having an aperture located thereon;

a first holder means, located within the housing unit, for rotatably holding a first paper towel roll;

a second holder means, located within the housing unit, for rotatably holding a second paper towel roll;

a paper plate;

a top plate, in substantial parallel spaced apart relation to the paper plate, forming a first channel;

a first set of spaced apart feed wheels for rotatably friction feeding paper from the first paper towel roll through the first channel;

a bottom plate, in substantial parallel spaced apart relation to the paper plate, forming a second channel;

a second set of spaced apart feed wheels for rotatably friction feeding paper from the second paper towel roll through the second channel;

motor means for rotating the first set of feed wheels and the second set of feed wheels;

a first sensor means, located within the housing unit, for detecting the presence or absence of paper on the first paper towel roll;

a second sensor means, located within the housing unit, for detecting the presence or absence of paper on the second paper towel roll;

a first control means for activating only one of either the first dispensing means or the second dispensing when the device is activated and switching to the other dispensing means when the respective sensor means detects an absence of paper on the current roll being dispensed; and an activation means, located on the housing, for activating paper dispension.

2. The device as in claim 1 wherein in the first holder means and the second holder means each comprise a pair of cooperating core plugs.

3. The device as in claim 1 wherein the first control means comprises:

a first shift means for positioning the first set of feed wheels in friction contact with the paper plate for friction feeding paper from the first paper towel roll and removing the second set of feed wheels from friction contact with the paper plate if paper is to be dispensed from the first paper towel roll or positioning the second set of feed wheels in friction contact with the paper plate for friction feeding paper from the first paper towel roll and removing the first set of feed wheels from friction contact with the paper plate if paper is to be dispensed from the second paper towel roll.

4. The device as in claim 1 wherein the first control means comprises a shift means for positioning the paper plate in friction contact with the first set of feed wheels for friction feeding paper from the first paper towel roll and removing the paper plate from friction contact with the second set of feed wheels if paper is to be dispensed from the first paper towel roll or for positioning the paper plate in friction contact with the second set of feed wheels for friction feeding paper from the second paper towel roll and removing the paper plate from friction contact with the first set of feed wheels if paper is to be dispensed from the second paper towel roll.

5. The device as in claim 1 further comprising:

an air dispension means located on the housing unit;

an air blower means, located within the housing unit, for blowing air out through the air dispension means;

a second control means, for activating the air blower means for a preset amount of time and thereafter deactivating the air blower means and activating the first control means, in response to activation of the activation means.

6. The device as in claim 5 to further include a heater located between the air blower means and the air dispenser means for heating the air being blown by the air dispenser means.

7. The device as in claim 5 wherein the air dispenser means comprises a nozzle.

8. The device as in claim 5 wherein the activation means comprises a depression switch.

9. The device as in claim 5 wherein the activation means comprises a sensing means for detection of a user.

10. The device as in claim 1 further comprising a display means for displaying the status of the first sensor means and the second sensor means.

11. A dual roll dispenser comprising:

a housing unit having an aperture located thereon;

a first holder means, located within the housing unit, for rotatably holding a first paper towel roll;

a second holder means, located within the housing unit, for rotatably holding a second paper towel roll;

a paper plate;

a top plate, in substantial parallel spaced apart relation to the paper plate, forming a first channel;

a first set of spaced apart feed wheels for rotatably friction feeding paper from the first paper towel roll through the first channel;

a first motor means for rotating the first set of feed wheels;

a bottom plate, in substantial parallel spaced apart relation to the paper plate, forming a second channel;

a second set of spaced apart feed wheels for rotatably friction feeding paper from the second paper towel roll through the second channel;

a second motor means for rotating the second set of feed wheels;

a first sensor means, located within the housing unit, for detecting the presence or absence of paper on the first paper towel roll;

a second sensor means, located within the housing unit, for detecting the presence or absence of paper on the second paper towel roll;

a first control means for activating only one of either the first dispensing means or the second dispensing when the device is activated and switching to the other dispensing means when the respective sensor means detects an absence of paper on the current roll being dispensed; and an activation means, located on the housing, for activating paper dispension.

12. The device as in claim 11 wherein the first holder means and the second holder means each comprise a pair of cooperating core plugs.

13. The device as in claim 11 further comprising:

an air dispension means located on the housing unit;

an air blower means, located within the housing unit, for blowing air out through the air dispension means; and a second control means, for activating the air blower means for a preset amount of time and thereafter deactivating the air blower means and activating the first control means, in response to activation of the activation means.

14. The device as in claim 11 to further include a heater located between the air blower means and the air dispenser means for heating the air being blown by the air dispenser means.

15. The device as in claim 11 wherein the air dispenser means comprises a nozzle.

16. The device as in claim 11 wherein the activation means comprises a depression switch.

17. The device as in claim 11 wherein the activation means comprises a sensing means for detection of a user.

18. The device as in claim 11 further comprising a display means for displaying the status of the first sensor means and the second sensor means.

19. A dual roll dispenser comprising:

a housing unit having an aperture located thereon;

a first holder means, located within the housing unit, for rotatably holding a first paper towel roll;

a second holder means, located within the housing unit, for rotatably holding a second paper towel roll;

a first dispensing means, located within the housing unit, for dispensing paper from the first paper towel roll out through the aperture;

a second dispensing means, located within the housing unit, for dispensing paper from the second paper towel roll out through the aperture;

a first sensor means, located within the housing unit, for detecting the presence or absence of paper on the first paper towel roll;

a second sensor means, located within the housing unit, for detecting the presence or absence of paper on the second paper towel roll;

a first control means for activating only one of either the dispensing means or the second dispensing when the device is activated and switching to the other dispensing means when the respective sensor means detects an absence of paper on the current roll being dispensed;

an air dispension means located on the housing unit;

an air blower means, located within the housing unit, for blowing air out through the air dispension means;

a second control means, for activating the air blower means for a preset amount of time and thereafter deactivating the air blower means and activating the first control means;

an activation means, located on the housing, for activating the second control means.

20. The device as in claim 19 wherein the first holder means and the second holder means each comprise a pair of cooperating core plugs.

21. The device as in claim 19 wherein the first dispension means and second dispension means comprise:

a paper plate;

a top plate, in substantial parallel spaced apart relation to the paper plate, forming a first channel;

a first set of spaced apart feed wheels for rotatably friction feeding paper from the first paper towel roll through the first channel;

a bottom plate, in substantial parallel spaced apart relation to the paper plate, forming a second channel;

a second set of spaced apart feed wheels for rotatably friction feeding paper from the second paper towel roll through the second channel; and a motor means for rotating the first set of feed wheels and the second set of feed wheels.

22. The device as in claim 21 wherein the first control means comprises:

a first shift means for positioning the first set of feed wheels in friction contact with the paper plate for friction feeding paper from the first paper towel roll and removing the second set of feed wheels from friction contact with the paper plate if paper is to be dispensed from the first paper towel roll or positioning the second set of feed wheels in friction contact with the paper plate for friction feeding paper from the first paper towel roll and removing the first set of feed wheels from friction contact with the paper plate if paper is to be dispensed from the second paper towel roll.

23. The device as in claim 21 wherein the first control means comprises a shift means for positioning the paper plate in friction contact with the first set of feed wheels for friction feeding paper from the first paper towel roll and removing the paper plate from friction contact with the second set of feed wheels if paper is to be dispensed from the first paper towel roll or for positioning the paper plate in friction contact with the second set of feed wheels for friction feeding paper from the second paper towel roll and removing the paper plate from friction contact with the first set of feed wheels if paper is to be dispensed from the second paper towel roll.

24. The device as in claim 19 wherein the first dispension means and second dispension means comprise:

a paper plate;

a top plate, in substantial parallel spaced apart relation to the paper plate, forming a first channel;

a first set of spaced apart feed wheels for rotatably friction feeding paper from the first paper towel roll through the first channel;

a first motor means for rotating the first set of feed wheels;

a bottom plate, in substantial parallel spaced apart relation to the paper plate, forming a second channel;

a second set of spaced apart feed wheels for rotatably friction feeding paper from the second paper towel roll through the second channel; and a second motor means for rotating the second set of feed wheels.

25. The device as in claim 19 to further include a heater located between the air blower means and the air dispenser means for heating the air being blown by the air dispenser means.

26. The device as in claim 19 wherein the air dispenser means comprises a nozzle.

27. The device as in claim 19 wherein the activation means comprises a depression switch.

28. The device as in claim 19 wherein the activation means comprises a sensing means for detection of a user.

29. The device as in claim 19 further comprising a display means for displaying the status of the first sensor means and the second sensor means.

* * * * *